US006551722B2

(12) United States Patent
Jonte et al.

(10) Patent No.: US 6,551,722 B2
(45) Date of Patent: Apr. 22, 2003

(54) COATED ARTICLE HAVING A STAINLESS STEEL COLOR

(75) Inventors: Patrick B. Jonte, Zionsville, IN (US); James S. Lipe, Carmel, IN (US); Guocun Chen, Broomfield, CO (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 09/832,564

(22) Filed: Apr. 11, 2001

(65) Prior Publication Data

US 2002/0150797 A1 Oct. 17, 2002

(51) Int. Cl.[7] ..... B32B 15/04

(52) U.S. Cl. ..... 428/687; 428/621; 428/629; 428/632; 428/660; 428/675; 428/680; 428/702; 428/469; 428/472; 428/622; 428/623; 428/627; 428/628; 428/633; 428/663; 428/666; 428/667; 428/668; 428/674; 428/698; 428/699; 428/701; 428/704

(58) Field of Search ..... 428/472, 621, 428/629, 632, 660, 675, 680, 687, 702, 622, 623, 627, 628, 633, 663, 666, 667, 668, 674, 469, 698, 699, 701, 707

(56) References Cited

U.S. PATENT DOCUMENTS

| | | | | |
|---|---|---|---|---|
| 5,413,874 | A | | 5/1995 | Moysan, III et al. |
| 5,476,724 | A | | 12/1995 | Moysan, III et al. |
| 5,478,659 | A | | 12/1995 | Moysan, III et al. |
| 5,478,660 | A | | 12/1995 | Moysan, III et al. |
| 5,482,788 | A | | 1/1996 | Moysan, III et al. |
| 5,484,663 | A | | 1/1996 | Moysan, III et al. |
| 5,552,233 | A | | 9/1996 | Moysan, III et al. |
| 5,626,972 | A | | 5/1997 | Moysan, III et al. |
| 5,639,564 | A | | 6/1997 | Moysan, III et al. |
| 5,641,579 | A | | 6/1997 | Moysan, III et al. |
| 5,648,179 | A | | 7/1997 | Moysan, III et al. |
| 5,654,108 | A | | 8/1997 | Moysan, III et al. |
| 5,667,904 | A | | 9/1997 | Moysan, III et al. |
| 5,783,313 | A | | 7/1998 | Moysan, III et al. |
| 5,814,415 | A | | 9/1998 | Moysan, III et al. |
| 5,879,532 | A | * | 3/1999 | Foster et al. ..... 205/192 |
| 5,922,478 | A | | 7/1999 | Welty et al. |
| 5,952,111 | A | | 9/1999 | Sugg et al. |
| 5,989,730 | A | | 11/1999 | Sugg et al. |
| 6,143,424 | A | | 11/2000 | Jonte et al. |
| 6,170,487 | B1 | * | 1/2001 | Ishiguro et al. ..... 128/897 |

OTHER PUBLICATIONS

Application Ser. No. 09/747,247 filed Dec. 21, 2000.
Application Ser. No. 09/827,193 filed Apr. 5, 2001.
Application Ser. No. 09/827,004 filed Apr. 5, 2001.
Application Ser. No. 09/827/005 filed Apr. 5, 2001.
Application Ser. No. 09/827,186 filed Apr. 5, 2001.
Application Ser. No. 09/827,187 filed Apr. 5, 2001.
Application Ser. No. 09/827,191 filed Apr. 5, 2001.
Application Ser. No. 09/827,189 filed Apr. 5, 2001.
Application Ser. No. 09/827,006 filed Apr. 5, 2001.

* cited by examiner

*Primary Examiner*—Deborah Jones
*Assistant Examiner*—A T Piziali
(74) *Attorney, Agent, or Firm*—Lloyd D. Doigan

(57) ABSTRACT

An article is coated with a multi-layer coating having a stainless steel color. The coating comprises an electroplated layer or layers on the article surface, a refractory metal or refractory metal alloy strike layer on the electroplated layer or layers, a color layer containing a refractory metal oxide or refractory metal alloy oxide having a substoichiometric oxygen content on the strike layer, and a refractory metal oxide or refractory metal alloy oxide having a substantially stoichiometric oxygen content layer on said color layer.

17 Claims, 2 Drawing Sheets

COATED ARTICLE HAVING A STAINLESS STEEL COLOR

FIELD OF THE INVENTION

This invention relates to articles coated with a multi-layered decorative and protective coating having the appearance or color of stainless steel.

BACKGROUND OF THE INVENTION

It is currently the practice with various brass articles such as faucets, faucet escutcheons, door knobs, door handles door escutcheons and the like to first buff and polish the surface of the article to a high gloss and to then apply a protective organic coating, such as one comprised of acrylics, urethanes, epoxies and the like, onto this polished surface. This system has the drawback that the buffing and polishing operation, particularly if the article is of a complex shape, is labor intensive. Also, the known organic coatings are not always as durable as desired, and are susceptible to attack by acids. It would, therefore, be quite advantageous if brass articles, or indeed other articles, either plastic, ceramic, or metallic, could be provided with a coating which provided the article with a decorative appearance as well as providing wear resistance, abrasion resistance and corrosion resistance. It is known in the art that a multi-layered coating can be applied to an article which provides a decorative appearance as well as providing wear resistance, abrasion resistance and corrosion resistance. This multi-layer coating includes a decorative and protective color layer of a refractory metal nitride such as a zirconium nitride or a titanium nitride. This color layer, when it is zirconium nitride, provides a brass color, and when it is titanium nitride provides a gold color.

U.S. Pat. Nos. 5,922,478; 6,033,790 and 5,654,108, inter alia, describe a decorative and protective coating which provides an article with a decorative color, such as polished brass, and provides wear resistance, abrasion resistance and corrosion resistance. It would be very advantageous if a decorative and protective coating could be provided which provided substantially the same properties as the coatings containing zirconium nitride or titanium nitride but instead of being brass colored or gold colored was stainless steel colored. The present invention provides such a coating.

SUMMARY OF THE INVENTION

The present invention is directed to an article such as a plastic, ceramic or metallic article having a decorative and protective multi-layer coating deposited on at least a portion of its surface. More particularly, it is directed to an article or substrate, particularly a metallic article such as stainless steel, aluminum, brass or zinc, having deposited on its surface multiple superposed layers of certain specific types of materials. The coating is decorative and also provides corrosion resistance, wear resistance and abrasion resistance. The coating provides the appearance of stainless steel, i.e. has a stainless steel color tone. Thus, an article surface having the coating thereon simulates a stainless steel surface.

The article has deposited on its surface at least one electroplated layer. On top of the electroplated layer is deposited, by vapor deposition such as physical vapor deposition, one or more vapor deposited layers. More particularly, disposed over the electroplated layer is a protective and decorative color layer comprised of a refractory metal oxide or refractory metal alloy oxide wherein the oxygen content of said oxide is substoichiometric. The substoichiometric oxygen content of these oxides is from about 5 to about 25 atomic percent, preferably from about 8 to about 18 atomic percent.

DESCRIPTION OF THE PREFERRED EMBODIMENTS

The article or substrate 12 can be comprised of any material onto which a plated layer can be applied, such as plastic, e.g., ABS, polyolefin, polyvinylchloride, and phenolformaldehyde, ceramic, metal or metal alloy. In one embodiment it is comprised of a metal or metallic alloy such as copper, steel, brass, zinc, aluminum, nickel alloys and the like.

Figure 1:
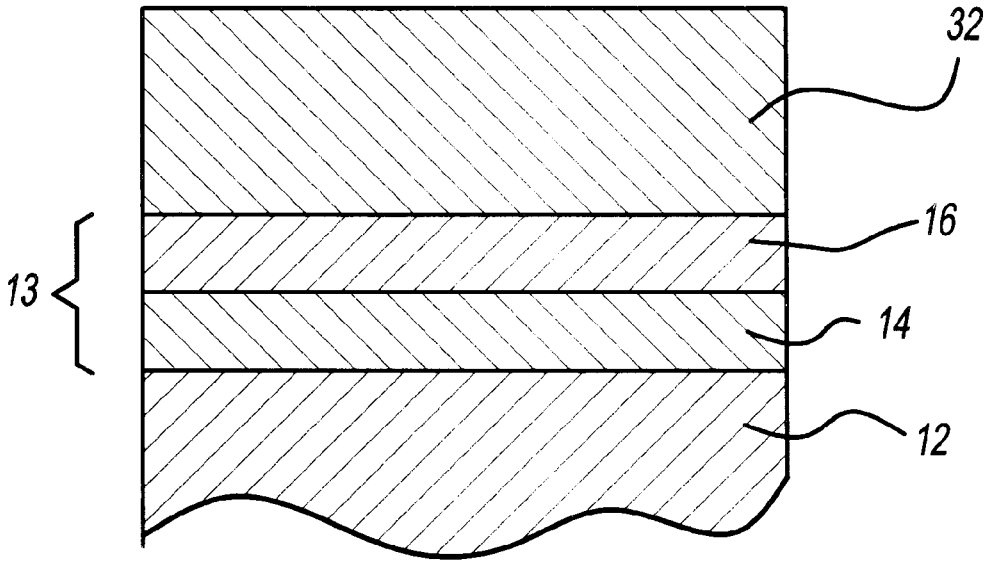
FIG. 1 is a cross-sectional view, not to scale, of a portion of the substrate having a semi-bright nickel layer on the surface of the substrate, a bright nickel layer on the semi-bright nickel layer, and a refractory metal oxide or refractory metal oxide color layer on the bright nickel layer.
Figure 2:
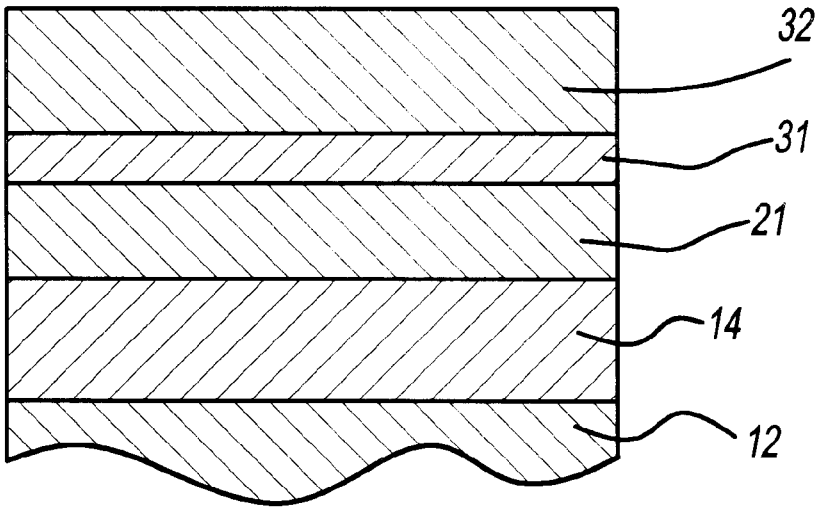
FIG. 2 is a view similar to FIG. 1 except that there is no bright nickel layer on the semi-bright nickel layer, there is a chrome layer on the semi-bright nickel layer, there is a refractory metal or refractory metal alloy strike layer on the chrome layer and a refractory metal oxide or refractory metal alloy oxide color layer on the strike layer.
Figure 3:
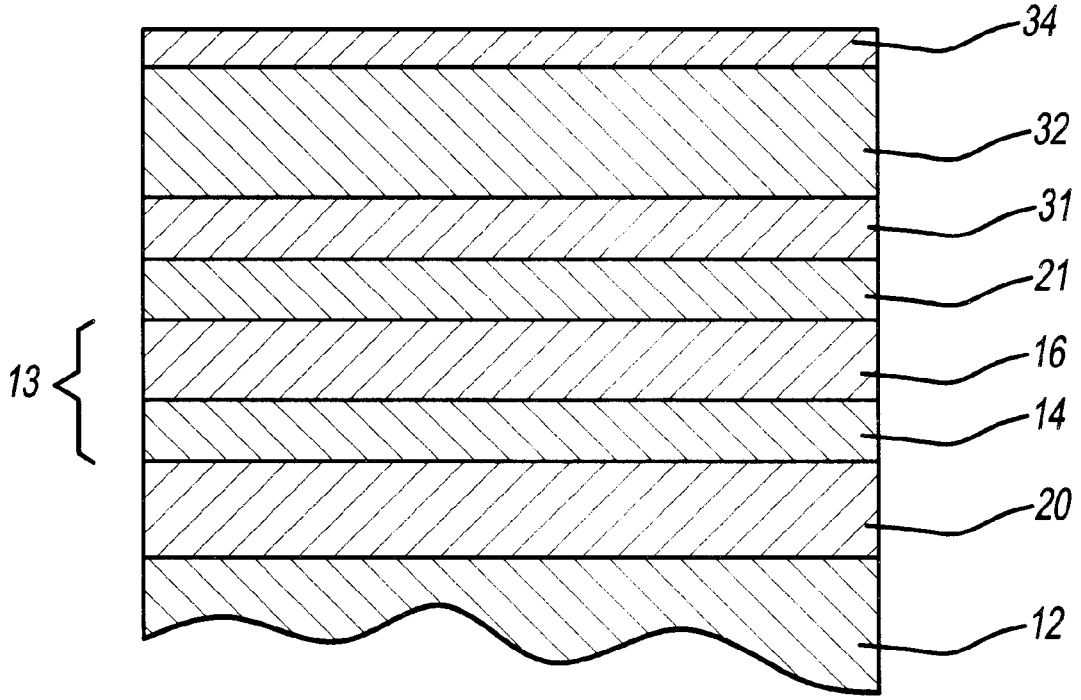
FIG. 3 is a view similar to FIG. 1 except there is a copper layer on the article surface, a semi-bright nickel layer on the copper layer, a bright nickel layer on the semi-bright nickel layer, a chrome layer on the bright nickel layer, a refractory metal or refractory metal alloy strike layer on the chrome layer, a color layer on the strike layer, and a refractory metal oxide or refractory metal alloy oxide having a substantially stoichimetric oxygen content layer on the color layer.

In the instant invention, as illustrated in FIGS. 1–3, a first layer or series of layers is applied onto the surface of the article by plating such as electroplating. A second series of layers is applied onto the surface of the electroplated layer or layers by vapor deposition. The electroplated layers serve, inter alia, as a basecoat which levels the surface of the article. In one embodiment of the instant invention a nickel layer 13 may be deposited on the surface of the article. The nickel layer may be any of the conventional nickels that are deposited by plating, e.g., bright nickel, semi-bright nickel, satin nickel, etc. The nickel layer 13 may be deposited on at least a portion of the surface of the substrate 12 by conventional and well-known electroplating processes. These processes include using a conventional electroplating bath such as, for example, a Watts bath as the plating solution. Typically such baths contain nickel sulfate, nickel chloride, and boric acid dissolved in water. All chloride, sulfamate and fluoroborate plating solutions can also be used. These baths can optionally include a number of well known and conventionally used compounds such as leveling agents, brighteners, and the like. To produce specularly bright nickel layer at least one brightener from class I and at least one brightener from class II is added to the plating solution. Class I brighteners are organic compounds which contain sulfur. Class II brighteners are organic compounds which do not contain sulfur. Class II brighteners can also cause leveling and, when added to the plating bath without the sulfur-containing class I brighteners, result in semi-bright nickel deposits. These class I brighteners include alkyl naphthalene and benzene sulfonic acids, the benzene and naphthalene di- and trisulfonic acids, benzene and naphthalene sulfonamides, and sulfonamides such as saccharin, vinyl and allyl sulfonamides and sulfonic acids. The class II brighteners generally are unsaturated organic materials such as, for example, acetylenic or ethylenic alcohols, ethoxylated and propoxylated acetylenic alcohols, coumarins, and aldehydes. These class I and class II brighteners are well known to those skilled in the art and are readily commercially available. They are described, inter alia, in U.S. Pat. No. 4,421,611 incorporated herein by reference.

The nickel layer can be comprised of a monolithic layer such as semi-bright nickel, satin nickel or bright nickel, or it can be a duplex layer containing two different nickel layers, for example, a layer comprised of semi-bright nickel and a layer comprised of bright nickel. The thickness of the nickel layer is generally a thickness effective to level the surface of the article and to provide improved corrosion resistance. This thickness is generally in the range of from about 2.5 μm, preferably about 4 μm to about 90 μm.

As is well known in the art before the nickel layer is deposited on the substrate the substrate is subjected to acid activation by being placed in a conventional and well known acid bath.

In one embodiment as illustrated in FIG. 1, the nickel layer 13 is actually comprised of two different nickel layers 14 and 16. Layer 14 is comprised of semi-bright nickel while layer 16 is comprised of bright nickel. This duplex nickel deposit provides improved corrosion protection to the underlying substrate. The semi-bright, sulfur-free plate 14 is deposited by conventional electroplating processes directly on the surface of substrate 12. The substrate 12 containing the semi-bright nickel layer 14 is then placed in a bright nickel plating bath and the bright nickel layer 16 is deposited on the semi-bright nickel layer 14.

The thickness of the semi-bright nickel layer and the bright nickel layer is a thickness at least effective to provide improved corrosion protection and/or leveling of the article surface. Generally, the thickness of the semi-bright nickel layer is at least about 1.25 μm, preferably at least about 2.5 μm, and more preferably at least about 3.5 μm. The upper thickness limit is generally not critical and is governed by secondary considerations such as cost. Generally, however, a thickness of about 40 pm, preferably about 25 μm, and more preferably about 20 μm should not be exceeded. The bright nickel layer 16 generally has a thickness of at least about 1.2 μm, preferably at least about 3 μm, and more preferably at least about 6 μm. The upper thickness range of the bright nickel layer is not critical and is generally controlled by considerations such as cost. Generally, however, a thickness of about 60 μm, preferably about 50 μm, and more preferably about 40 μm should not be exceeded. The bright nickel layer 16 also functions as a leveling layer which tends to cover or fill in imperfections in the substrate.

In one embodiment, as illustrated in FIGS. 2 and 3, disposed between the nickel layer 13 and the vapor deposited layers are one or more additional electroplated layers 21. These additional electroplated layers include, but are not limited to, chromium, tin-nickel alloy, and the like. When layer 21 is comprised of chromium it may be deposited on the nickel layer 13 by conventional and well known chromium electroplating techniques. These techniques along with various chrome plating baths are disclosed in Brassard, "Decorative Electroplating—A Process in Transition", Metal Finishing, pp. 105–108, June 1988; Zaki, "Chromium Plating", PF Directory, pp. 146–160; and in U.S. Pat. Nos. 4,460,438; 4,234,396; and 4,093,522, all of which are incorporated herein by reference.

Chrome plating baths are well known and commercially available. A typical chrome plating bath contains chromic acid or salts thereof, and catalyst ion such as sulfate or fluoride. The catalyst ions can be provided by sulfuric acid or its salts and fluosilicic acid. The baths may be operated at a temperature of about 112–116° F. Typically in chrome plating a current density of about 150 amps per square foot, at about 5 to 9 volts is utilized.

The chrome layer generally has a thickness of at least about 0.05 μm, preferably at least about 0.12 μm, and more preferably at least about 0.2 μm. Generally, the upper range of thickness is not critical and is determined by secondary considerations such as cost. However, the thickness of the chrome layer should generally not exceed about 1.5 μm, preferably about 1.2 μm, and more preferably about 1 μm.

Instead of layer 21 being comprised of chromium it may be comprised of tin-nickel alloy, that is an alloy of nickel and tin. The tin-nickel alloy layer may be deposited on the surface of the substrate by conventional and well known tin-nickel electroplating processes. These processes and plating baths are conventional and well known and are disclosed, inter alia, in U.S. Pat. Nos. 4,033,835; 4,049,508; 3,887,444; 3,772,168 and 3,940,319, all of which are incorporated herein by reference.

The tin-nickel alloy layer is preferably comprised of about 60–70 weight percent tin and about 30–40 weight percent nickel, more preferably about 65% tin and 35% nickel representing the atomic composition SnNi. The plating bath contains sufficient amounts of nickel and tin to provide a tin-nickel alloy of the afore-described composition.

A commercially available tin-nickel plating process is the NiColloy™ process available from ATOTECH, and described in their Technical Information sheet No: NiColloy, Oct. 30, 1994, incorporated herein by reference.

The thickness of the tin-nickel alloy layer 21 is generally at least about 0.25 μm, preferably at least about 0.5 μm, and more preferably at least about 1.2 μm. The upper thickness range is not critical and is generally dependent on economic considerations. Generally, a thickness of about 50 μm, preferably about 25 μm, and more preferably about 15 μm should not be exceeded.

In yet another embodiment, as illustrated in FIG. 3, the electroplated layers comprise a copper layer or layers 20 deposited on the article surface 12, a nickel layer or layers 13 on the copper layer 20, and a chromium layer 21 on the nickel layer 13.

In this embodiment the copper layer or layers 21 are deposited on at least a portion of the article surface by conventional and well known copper electroplating processes. Copper electroplating processes and copper electroplating baths are conventional and well known in the art. They include the electroplating of acid copper and alkaline copper. They are described, inter alia, in U.S. Pat. Nos. 3,725,220; 3,769,179; 3,923,613; 4,242,181 and 4,877,450, the disclosures of which are incorporated herein by reference.

The preferred copper layer 21 is selected from alkaline copper and acid copper. The copper layer may be monolithic and consist of one type of copper such as alkaline copper or acid copper, or it may comprise two different copper layers such as a layer comprised of alkaline copper and a layer comprised of acid copper.

The thickness of the copper layer is generally in the range of from at least about 2.5 microns, preferably at least about 4 microns to about 100 microns, preferably about 50 microns.

When a duplex copper layer is present comprised of, for example, an alkaline copper layer and an acid copper layer, the thickness of the alkaline copper layer is generally at least about 1 micron, preferably at least about 2 microns. The upper thickness limit is generally not critical. Generally, a thickness of about 40 microns, preferably about 25 microns, should not be exceeded. The thickness of the acid copper layer is generally at least about 10 microns, preferably at least about 20 microns. The upper thickness limit is generally not critical. Generally, a thickness of about 40 microns, preferably about 25 microns, should not be exceeded.

The nickel layer 13 may be deposited on the surface of the copper layer 21 by conventional and well-known electroplating processes. These processes are described above.

The nickel layer 13, as in the embodiment described above, can be comprised of a monolithic layer such as semi-bright nickel or bright nickel, or it can be a duplex layer containing two different nickel layers, for example, a layer comprised of semi-bright nickel 14 and a layer comprised of bright nickel 16.

Disposed over the nickel layer 13, preferably the bright nickel layer 16, is a layer 21 comprised of chrome. The chrome layer 21 may be deposited on layer 16 by conventional and well known chromium electroplating techniques.

In another embodiment, as illustrated in FIG. 3, a semi-bright nickel layer 14 is deposited on the surface of the article and a chromium layer 21 is deposited on the semi-bright nickel layer.

The stainless steel appearing coating can also have a brushed texture. This is accomplished by texturing the substrate by using, for example, a buffing lathe equipped with a Scotch Brite type buffing wheel. A bright nickel layer should generally not be used when a brushed stainless steel appearance is desired because the bright nickel layer will levelize the texture left by the buffing and eliminate or at least diminish the brushed appearance.

The stainless steel appearing coating can also have a matte texture. This is accomplished by using, for example, a Pearl Brite type nickel plating chemistry instead of a bright nickel.

Over the electroplated layer or layers is deposited, by vapor deposition such as physical vapor deposition and chemical vapor deposition, a protective and decorative color layer 32 comprised of a refractory metal oxide or refractory metal alloy oxide having a low, i.e., substoichiometric, oxygen content. This low, substoichiometric oxygen content is generally from about 5 atomic percent to about 25 atomic percent, preferably from about 8 atomic percent to about 18 atomic percent.

This low oxygen content of the refractory metal oxide or refractory metal alloy oxide comprising color layer 32 is, inter alia, responsible for the stainless steel color of color layer 32.

The refractory metal comprising the refractory metal oxide is zirconium, titanium, hafnium and the like, preferably zirconium, titanium or hafnium. A refractory metal alloy such as zirconium-titanium alloy, zirconium-hafnium alloy, titanium-hafnium alloy, and the like may also be used to form the oxide. Thus, for example, the oxide may include a zirconium-titanium alloy oxide.

The thickness of this color and protective layer 32 is a thickness which is at least effective to provide the color of stainless steel and to provide abrasion resistance, scratch resistance, wear resistance and improved chemical resistance. Generally, this thickness is at least about 1,000 Å, preferably at least about 1,500 Å, and more preferably at least about 2,500 Å. The upper thickness range is generally not critical and is dependent upon secondary considerations such as cost. Generally a thickness of about 0.75 $\mu$n, preferably about 0.5 $\mu$m should not be exceeded.

One method of depositing layer 32 is by physical vapor deposition utilizing reactive sputtering or reactive cathodic arc evaporation. Reactive cathodic arc evaporation and reactive sputtering are generally similar to ordinary sputtering and cathodic arc evaporation except that a reactive gas is introduced into the chamber which reacts with the dislodged target material. Thus, in the instant case where layer 32 is comprised of zirconium oxide, the cathode is comprised of zirconium, and oxygen is the reactive gas introduced into the chamber.

In addition to the protective color layer 32 there may be present additional vapor deposited layers. These additional vapor deposited layers may include a layer comprised of refractory metal or refractory metal alloy. The refractory metals include hafnium, tantalum, zirconium and titanium. The refractory metal alloys include zirconium-titanium alloy, zirconium-hafnium alloy and titanium-hafnium alloy. The refractory metal layer or refractory metal alloy layer 31 generally functions, inter alia, as a strike layer which improves the adhesion of the color layer 32 to the electroplated layer(s). As illustrated in FIGS. 2 and 3, the refractory metal or refractory metal alloy strike layer 31 is generally disposed intermediate the color layer 32 and the top electroplated layer. Layer 31 has a thickness which is generally at least effective for layer 31 to function as a strike layer. Generally, this thickness is at least about 60 Å, preferably at least about 120 Å, and more preferably at least about 250 Å. The upper thickness range is not critical and is generally dependent upon considerations such as cost. Generally, however, layer 31 should not be thicker than about 1.2 $\mu$m, preferably about 0.5 $\mu$m, and more preferably about 0.25 $\mu$m.

The refractory metal or refractory metal alloy layer 31 is deposited by conventional and well known vapor deposition techniques including physical vapor deposition techniques such as cathodic arc evaporation (CAE) or sputtering. Sputtering techniques and equipment are disclosed, inter alia, in J. Vossen and W. Kern "Thin Film Processes II", Academic Press, 1991; R. Boxman et al, "Handbook of Vacuum Arc Science and Technology", Noyes Pub., 1995; and U.S. Pat. Nos. 4,162,954 and 4,591,418, all of which are incorporated herein by reference.

Briefly, in the sputtering deposition process a refractory metal (such as titanium or zirconium) target, which is the cathode, and the substrate are placed in a vacuum chamber. The air in the chamber is evacuated to produce vacuum conditions in the chamber. An inert gas, such as Argon, is introduced into the chamber. The gas particles are ionized and are accelerated to the target to dislodge titanium or zirconium atoms. The dislodged target material is then typically deposited as a coating film on the substrate.

In cathodic arc evaporation, an electric arc of typically several hundred amperes is struck on the surface of a metal cathode such as zirconium or titanium. The arc vaporizes the cathode material, which then condenses on the substrates forming a coating.

In a preferred embodiment of the present invention the refractory metal is comprised of titanium or zirconium, preferably zirconium, and the refractory metal alloy is comprised of zirconium-titanium alloy.

Over color layer 32 is a thin layer 34 comprised of refractory metal oxide or refractory metal alloy oxide wherein the oxygen content is generally stoichiometric or slightly less than stoichiometric. In layer 34 the oxygen content is generally from about 50 atomic percent (slightly less than stoichiometric) to about 67 atomic percent (stoichiometric).

In another embodiment instead of layer 34 being comprised of a refractory metal oxide or refractory metal alloy oxide it is comprised of the reaction products of a refractory metal or refractory metal alloy, oxygen and nitrogen. The reaction products of refractory metal or refractory metal alloy, oxygen and nitrogen are generally comprised of the refractory metal oxide or refractory metal alloy oxide, refractory metal nitride or refractory metal alloy nitride and refractory metal oxy-nitride or refractory metal alloy oxy-nitride. Thus, for example, the reaction products of zirconium, oxygen and nitrogen comprise zirconium oxide, zirconium nitride and zirconium oxy-nitride. These refractory metal oxides and refractory metal nitrides including zirconium oxide and zirconium nitride alloys and their preparation and deposition are conventional and well known, and are disclosed, inter alia, in U.S. Pat. No. 5,367,285, the disclosure of which is incorporated herein by reference.

Layer 34 is effective in providing improved oxidation resistance and chemical, such as acid or base, resistance to the coating. Layer 34 containing a refractory metal oxide or a refractory metal alloy oxide generally has a thickness at least effective to provide improved oxidation and chemical resistance. Generally this thickness is at least about 10 Å, preferably at least about 25 Å, and more preferably at least about 40 Å. Layer 34 should be thin enough so that it does not obscure the color of underlying color layer 32. That is to say layer 34 should be thin enough so that it is non-opaque or substantially transparent. Generally layer 34 should not be thicker than about 0.10 $\mu$m, preferably about 250 Å, and more preferably about 100 Å.

In order that the invention may be more readily understood, the following example is provided. The example is illustrative and does not limit the invention thereto.

EXAMPLE 1

Brass faucets are placed in a conventional soak cleaner bath containing the standard and well known soaps, detergents, defloculants and the like which is maintained at a pH of 8.9–9.2 and a temperature of about 145–200° F. for 10 minutes. The brass faucets are then placed in a conventional ultrasonic alkaline cleaner bath. The ultrasonic cleaner bath has a pH of 8.9–9.2, is maintained at a temperature of about 160–180° F., and contains the conventional and well known soaps, detergents, defloculants and the like. After the ultrasonic cleaning the faucets are rinsed and placed in a conventional alkaline electro cleaner bath for about 50 seconds. The electro cleaner bath is maintained at a temperature of about 140–180° F., a pH of about 10.5–11.5, and contains standard and conventional detergents.

The faucets are then rinsed and placed in a conventional acid activator bath for about 20 seconds. The acid activator bath has a pH of about 2.0–3.0, is at an ambient temperature, and contains a sodium fluoride based acid salt.

The faucets are then rinsed and placed in a conventional and standard acid copper plating bath for about 14 minutes. The acid copper plating bath contains copper sulfate, sulfuric acid, and trace amounts of chloride. The bath is maintained at about 80° F. A copper layer of an average thickness of about 10 microns is deposited on the faucets.

The faucets containing the layer of copper are then rinsed and placed in a bright nickel plating bath for about 12 minutes. The bright nickel bath is generally a conventional bath which is maintained at a temperature of about 130–150° F., a pH of about 4.0–4.8, contains $NiSO_4$, $NiCL_2$, boric acid and brighteners. A bright nickel layer of an average thickness of about 10 microns is deposited on the copper layer. The copper and bright nickel plated faucets are rinsed three times and then placed in a conventional, commercially available hexavalent chromium plating bath using conventional chromium plating equipment for about seven minutes. The hexavalent chromium bath is a conventional and well known bath which contains about 32 ounces/gallon of chromic acid. The bath also contains the conventional and well known chromium plating additives. The bath is maintained at a temperature of about 112–116° F., and utilizes a mixed sulfate/fluoride catalyst. The chromic acid to sulfate ratio is about 200:1. A chromium layer of about 0.25 microns is deposited on the surface of the bright nickel layer. The faucets are thoroughly rinsed in de-ionized water and then dried. The chromium plated faucets are placed in a cathodic arc evaporation plating vessel. The vessel is generally a cylindrical enclosure containing a vacuum chamber which is adapted to be evacuated by means of pumps. Sources of argon gas and oxygen are connected to the chamber by an adjustable valve for varying the rate of flow of argon and oxygen into the chamber.

A cylindrical cathode is mounted in the center of the chamber and connected to negative outputs of a variable D.C power supply. The positive side of the power supply is connected to the chamber wall. The cathode material comprises zirconium.

The plated faucets are mounted on spindles, 16 of which are mounted on a ring around the outside of the cathode. The entire ring rotates around the cathode while each spindle also rotates around its own axis, resulting in a so-called planetary motion which provides uniform exposure to the cathode for the multiple faucets mounted around each spindle. The ring typically rotates at several rpm, while each spindle makes several revolutions per ring revolution. The spindles are electrically isolated from the chamber and provided with rotatable contacts so that a bias voltage may be applied to the substrates during coating.

The vacuum chamber is evacuated to a pressure of $5\times100^{-3}$ millibar and heated to about 100° C.

The electroplated faucets are then subjected to a high-bias arc plasma cleaning in which a (negative) bias voltage of about 500 volts is applied to the electroplated faucets while an arc of approximately 500 amperes is struck and sustained on the cathode. The duration of the cleaning is approximately five minutes.

The introduction of argon gas is continued at a rate sufficient to maintain a pressure of about 1 to 5 millitorr. A layer of zirconium having an average thickness of about 0.1 microns is deposited on the electroplated faucets during a three minute period. The cathodic arc deposition process comprises applying D.C. power to the cathode to achieve a current flow of about 460 amperes, introducing argon gas into the vessel to maintain the pressure in the vessel at about 2 millitorr and rotating the faucets in a planetary fashion described above.

After the zirconium layer is deposited a protective and decorative color layer comprised of zirconium oxide, wherein the oxygen content is from about 8 to about 18 atomic percent, is deposited on the zirconium layer. The flow rate of argon gas is continued at about 250 sccm and oxygen is introduced at a flow rate of about 50 sccm, while the arc discharge continues at approximately 460 amperes. The flow of argon and oxygen is continued for about 40 minutes. The thickness of the color layer is about 3500–4500 Å. After this color layer is deposited the flow of argon gas is terminated and the flow of oxygen gas is increased to about 500 sccm, while continuing the current flow. The flow of oxygen at this level continues for about 0.5 minutes. A zirconium oxide layer having a substantially stoichiometric oxygen content is formed having a thickness of about 40–100 Å. The arc is extinguished, the vacuum chamber is vented, and the coated articles removed.

While certain embodiments of the invention have been described for purposes of illustration, it is to be understood that there may be other various embodiments and modifications within the general scope of the invention.

We claim:

1. An article having on at least a portion of its surface a multi-layer coating having the appearance of stainless steel said coating comprising:

at least one electroplated layer;

a color layer comprised of a refractory metal oxide or refractory metal alloy oxide wherein the oxygen content of said refractory metal oxide or refractory metal alloy oxide is a substoichiometric amount of from about 5 atomic percent to about 25 atomic percent.

2. The article of claim 1 wherein said substoichiometric oxygen content is from about 8 atomic percent to about 18 atomic percent.

3. The article of claim 1 wherein a strike layer comprised of a refractory metal or refractory metal alloy is intermediate said at least one electroplated layer and said color layer.

4. The article of claim 3 wherein a layer comprised of refractory metal oxide or refractory metal oxide having a substantially stoichiometric oxygen content is on said color layer.

5. The article of claim 3 wherein a layer comprised of the reaction products of a refractory metal or refractory metal alloy, oxygen and nitrogen is on said color layer.

6. The article of claim 1 wherein a layer comprised of the reaction products of a refractory metal or a refractory metal alloy, oxygen and nitrogen is on said color layer.

7. The article of claim 1 wherein said at least one electroplated layer is comprised of at least one nickel layer.

8. The article of claim 7 wherein said at least one electroplated layer is comprised of a chromium layer.

9. The article of claim 8 wherein said at least one electroplated layer is comprised of a copper layer.

10. The article of claim 1 wherein said at least one electroplated layer is comprised of a nickel layer on said article and a chromium layer on said nickel layer.

11. The article of claim 1 wherein said electroplated layer is comprised of at least one copper-layer on said article, at least one nickel layer on said at least one copper layer, and a chromium layer on said at least one nickel layer.

12. An article having on at least a portion of its surface a multi-layer coating having the appearance of stainless steel said coating comprising:

at least one electroplated layer on the surface of said article, and a color layer comprised of a refractory metal oxide or refractory metal alloy oxide having a substoichiometric oxygen content of from about 5 to about 25 atomic percent on said at least one electroplated layer; and a refractory metal oxide or refractory metal alloy oxide having a substantially stoichiometric oxygen content on said color layer.

13. The article of claim 12 wherein said substoichiometric oxygen content is from about 8 to about 18 atomic percent.

14. The article of claim 12 wherein a layer comprised of refractory metal or refractory metal alloy is intermediate said at least one electroplated layer and said color layer.

15. The article of claim 14 wherein said at least one electroplated layer is comprised of at least one nickel layer.

16. The article of claim 15 wherein a chromium layer is on said at least one nickel layer.

17. The article of claim 15 wherein a layer comprised of the reaction products of refractory metal or refractory metal alloy, oxygen and nitrogen is on said color layer.

* * * * *